United States Patent [19]

Bennett

[11] 3,982,803

[45] Sept. 28, 1976

[54] CABLE AND CONVERTER SECURITY DEVICE

[76] Inventor: Harry A. Bennett, 17513 Lorne St., Northridge, Calif. 91324

[22] Filed: Mar. 17, 1975

[21] Appl. No.: 558,791

[52] U.S. Cl. ..... 339/37; 200/51.1; 339/177 R

[51] Int. Cl.[2] ..... H01R 13/62

[58] Field of Search ..... 339/37, 39, 74 R, 81–87, 339/89 C, 95 D, 177, 178; 200/51.1

[56] References Cited

UNITED STATES PATENTS

| | | | |
|---|---|---|---|
| 1,939,259 | 12/1933 | Good | 339/74 R |
| 2,955,272 | 10/1960 | Gallardo | 339/37 |
| 2,997,681 | 8/1961 | Klassen | 339/74 R |
| 3,525,973 | 8/1970 | Kipnes | 339/177 R |
| 3,573,702 | 4/1971 | O'Keefe | 339/37 |
| 3,587,033 | 6/1971 | Brorein et al. | 339/177 R |
| 3,656,087 | 4/1972 | Nutton | 339/95 D |

*Primary Examiner*—Roy Lake
*Assistant Examiner*—Neil Abrams
*Attorney, Agent, or Firm*—Lindenberg, Freilich, Wasserman, Rosen & Fernandez

[57] ABSTRACT

A device is presented for coupling either a coaxial cable to a coaxial plug or two coaxial cables to one another, requiring a presetting, or activation operation to occur prior to making the coupling or the device will not permit electrical coupling to occur. Also, once the coaxial cable coupling to the device is removed, the device is inactivated so that the electrical connection cannot be made again unless a new presetting operation is performed.

1 Claim, 4 Drawing Figures

CABLE AND CONVERTER SECURITY DEVICE

BACKGROUND OF THE INVENTION

This invention relates to electrical connecting or coupling devices and more particularly to improvement therein.

In community antenna television systems, commonly known as CATV a converter is normally connected between incoming lines from the distribution system of the CATV operation and a subscriber's television receiver. One of the problems which arises is that the subscriber either lends his converter to other individuals who may not be subscribers, but who still have a CATV input plug in their apartment, or the subscriber may move, taking the CATV converter with him. If he moves to a location such as another apartment project, which has the CATV plugs present, he need not become a subscriber while still enjoying subscriber privileges.

In order to prevent these occurrences, some type of device is required, which either prevents decoupling once the connection between the converter and the incoming CATV plug is broken, it should be extremely difficult if not possible to make such connection again. In other words, some type of security device is required.

A security device of similar suitable type can also find utility where it is desired that once coupling between coaxial cables is made, anyone who uncouples the electrical connections which are made through the coupling device should not be able to recouple or make electrical connections again, unless proper equipment for permitting this, obviously held by authorized personnel, occurs. The same requirement holds true in the coupling of power lines. Only authorized personnel should be able to make connections again, once uncoupling has occurred.

OBJECT AND SUMMARY OF THE INVENTION

An object of this invention is the provision of an electrical coupling device which, unless properly activated prior to making a coupling will not pass an electrical signal therethrough.

Yet another object of this invention is to provide an electrical coupling device which acts as a security device against unauthorized coupling.

Still another object of this invention is the provision of a security device which prevents removal of the device from equipment and/or transmission lines by unauthorized personnel.

Still another object of this invention is to provide a novel, useful and relatively inexpensive security coupling device.

The novel features of the invention are set forth with particularity in the appended claims. The invention will best be understood from the following description when read in conjunction with the accompanying drawings.

A BRIEF DESCRIPTION OF THE DRAWINGS

DESCRIPTION OF THE INVENTION

Figure 1:
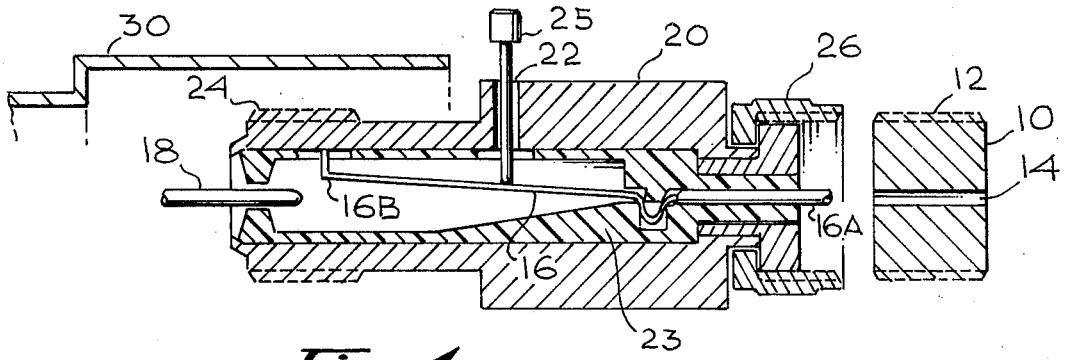
FIG. 1 is a cross section, exploded view of an embodiment of the invention.

The problem of maintaining secure the connection of the devices such as the above mentioned converter to an electrical line and preventing reconnection in the event of a separation is solved by the embodiment of the invention shown in FIG. 1 wherein, the reference numeral 10 is applied to a coaxial plug having a threaded exterior 12 and an opening 14 therein into which the central conductor of a coaxial cable is to be inserted. The coupler, in accordance with this invention, comprises a central conductor 16, having one end 16A which extends outside of the coupler so that it can be inserted into the central opening 14. The other end 16B of the central conductor extends and is formed into a tension contact. This is done by forming the round metal of the central conductor into a flat state and tempering it to have a proper spring tension. It is placed in the coupler in a manner so that in the deactivated state, which is the state shown in FIG. 1, the contact 16B is bent upward and cannot be contacted by the pin 18 of the coaxial cable from which it extends.

The coupler has a metal shell 20 which has an opening therein 22, to permit the insertion of a tool 24 which is used to push the spring biased contact 16B downward, when it is desired to activate the coupler. The central conductor 16 is supported and maintained electrically insulated by a centrally spaced cylinder of insulated material 23. The shell 20 is threaded at its outer end 24 to engage with the coupling device on the coaxial cable to which it is to be coupled.

A threaded nut 26, which has been press fitted into the receiving bushing portion, is screwed onto the threaded plug. Then, the tool 25 is used to push down the spring contact portion 16B of the central conductor far enough so that when the pin 18 is inserted, the spring contact is below the pin. Then, as shown in FIG. 2, the tool 25 is removed, as a result of which the spring contact 16B moves into engagement with the pin 18.

A cover shell 30, comprises a two different diameter concentric cylinder and covers the hole 22 through which a tool can be inserted and also, covers the threaded nut 26. This outer shell is crimped onto the shell 20, once it is placed in position, as shown in FIG. 2, so that it cannot be removed. As a result, the coupler is locked into position since access cannot be had to the threaded nut to unscrew it. Upon removal of the pin 18 from the coupler the contact 16B will resume the position shown in FIG. 1 and will thereby prevent electrical connection again being made thereto without proper activation with the tool 24.

Figure 2:
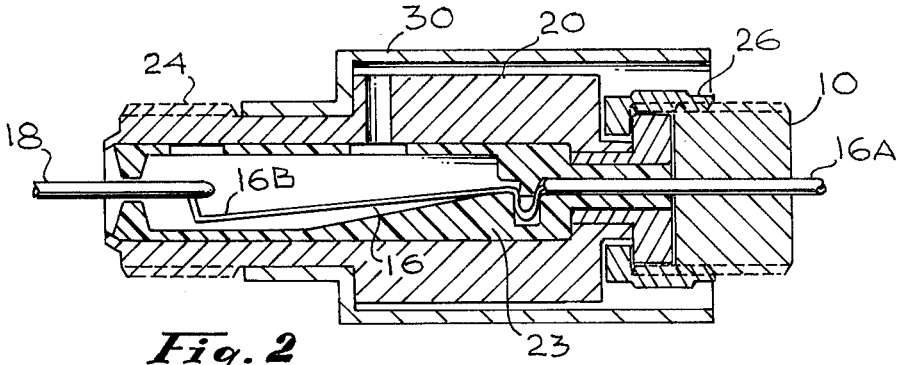
FIG. 2 is a cross section of the embodiment of the invention shown in FIG. 1 which is assembled and in operation.
Figure 3:
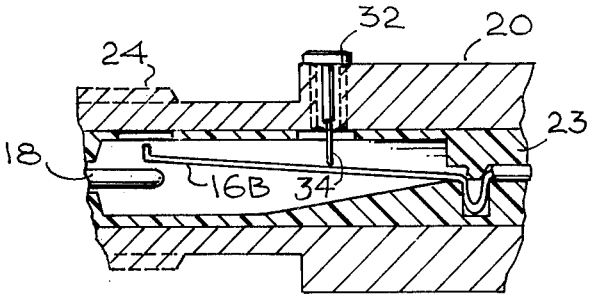
FIG. 3 is a cross sectional view of another embodiment of the invention.

FIG. 3 is a cross sectional portion of an embodiment of the invention shown in FIGS. 1 or 2 except that the walls forming the hole 22 are threaded to enable a device 32 to be threaded therein. The threaded device has a pin 34 which can serve to hold the spring contact 16B at some desired position, not in contact with the shell wall, when the coupler is inactivated. To activate the coupler the threaded device 32 must be removed and the tool 25 be inserted, in the manner described previously in connection with FIGS. 1 and 2. This arrangement may be used where it is not desired to ground the central conductor, but a termination device is required.

Figure 4:
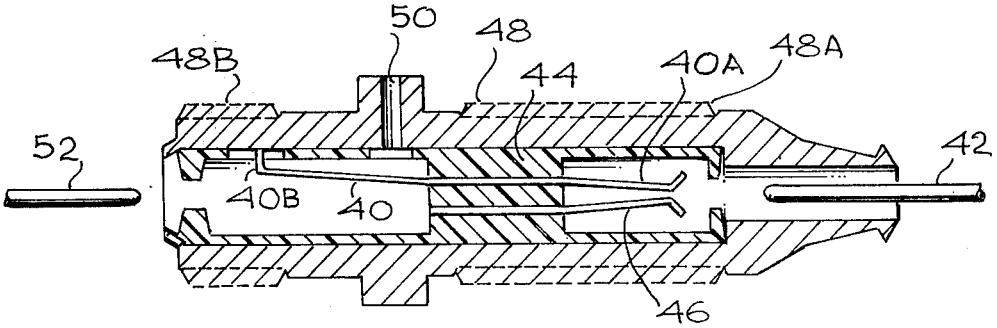
FIG. 4 is a cross sectional view of still another embodiment of the invention.

FIG. 4 is another embodiment of the invention which comprises a coupler for interconnecting coaxial cables.

Again, there is provided a central conductor 40, which has one end 40B flat and treated to insure spring tension. The back portion 40A of the central conductor is also flat and tempered to have a spring bias. As is shown in FIG. 4 the bias is toward the center, and insulating cylindrical body 44 supports the conductor 40 and another conductor 46. This conductor 46 has an extending end opposite the end 40A which is tempered to have a spring bias toward the end 40A, so that when the pin 42 of a coaxial conductor is inserted therebetween, an excellent electrical connection will be made. The conducting shell 48 has threads 48A and 48B respectively, on opposite ends thereof to permit engagement with threaded nuts which are on the coupling devices mounted on the coaxial conductors for chassis or wall mounting.

An opening, 50, is provided in the shell 48 to enable a tool, such as shown in FIG. 1, to be inserted therein to hold the spring contact 40B sufficiently below the incoming pin 52, so that when the tool is removed, the pin 52 will be engaged by the contact 40B.

It should be obvious that when the pin 52 is withdrawn, reconnection cannot be made unless a spring contact 40B is pushed downward or activated by the appropriate tool.

There is accordingly described and shown herein, a novel and useful coupling device which provides security against removal and/or reconnection between devices with which they are used for coupling.

I claim:

1. In a system wherein it is desired to prevent unauthorized connection of a coaxial coupling device to a coaxial cable by requiring the use of a special tool means for affording coupling to the central conductor of said coaxial cable, said coaxial coupling device comprising a conductive cylindrical body having a central cylindrical opening extending therethrough, insulating wall means closing one end of said conductive cylindrical body, said wall means having a central opening for enabling the insertion of said coaxial cable central conductor therethrough into said central cylindrical opening, a coupling conductor within said central cylindrical opening, insulating means supporting said coupling conductor between its ends within said central opening of said conductive cylindrical body, one end of said coupling conductor extending towards said insulating wall means for contacting said coaxial cable central conductor, said one end of said central conductor having resilient properties and being yieldably biased to a first position which is out of contact with an inserted coaxial cable central conductor, and being movable to a second position for affording contact with a coaxial cable central conductor which is inserted through said insulating wall means after said central conductor one end is moved to said second position, means for affording access to said resilient one end of said central conductor consisting of an opening in said cylindrical body positioned for enabling removable insertion therethrough of said tool means for moving said resilient one end of said central conductor from its first to its second position, means forming a bushing at the end of said conductive cylindrical body opposite to the end toward which said one end of said central conductor extends, a threaded nut pressed upon said bushing and having a threaded end extending away from the end of said cylindrical body for engaging a threaded plug, and a hollow cylinder for insertion over said conductive cylindrical body for covering said opening therein and said threaded nut.

* * * * *